US006736372B2

(12) United States Patent
Earsley et al.

(10) Patent No.: US 6,736,372 B2
(45) Date of Patent: May 18, 2004

(54) APPARATUS AND A SYSTEM FOR LIFTING A TRAILER AND A METHOD FOR LIFTING AND STORING THE TRAILER

(76) Inventors: Craig A. Earsley, 817 Red Barn La., Elgin, IL (US) 60123-6552; Susan E. Earsley, 817 Red Barn La., Elgin, IL (US) 60123-6552; Kent E. Erickson, 7556 N. Brown Rd., Columbia City, IN (US) 46725; Renee Erickson, 7556 N. Brown Rd., Columbia City, IN (US) 46725

( * ) Notice: Subject to any disclaimer, the term of this patent is extended or adjusted under 35 U.S.C. 154(b) by 0 days.

(21) Appl. No.: 10/244,621

(22) Filed: Sep. 16, 2002

(65) Prior Publication Data

US 2004/0051091 A1 Mar. 18, 2004

(51) Int. Cl.[7] ..... B66D 1/36

(52) U.S. Cl. ..... 254/334; 254/390; 248/320; 248/327; 414/629; 414/630; 294/74

(58) Field of Search ..... 254/334, 362, 254/375, 390; 248/327, 323, 321, 320, 328; 414/629, 626, 630; 294/74

(56) References Cited

U.S. PATENT DOCUMENTS 326,330 A * 9/1885 Ricker ..... 54/84
3,774,788 A * 11/1973 Sowers et al. ..... 414/543
3,876,081 A * 4/1975 Metzger ..... 213/69
4,600,177 A * 7/1986 Fritz ..... 254/335
5,263,687 A * 11/1993 Garbiso ..... 254/334
5,327,592 A * 7/1994 Stump ..... 5/81.1 R
5,897,104 A * 4/1999 Garbiso ..... 254/334
5,984,275 A * 11/1999 Hoslett ..... 254/338
6,056,274 A * 5/2000 Naas et al. ..... 254/335
6,105,938 A * 8/2000 Koida ..... 254/278
6,152,427 A * 11/2000 Hoslett ..... 254/338
6,237,781 B1 * 5/2001 Dahl ..... 211/17
6,386,515 B1 * 5/2002 Sachtleben ..... 254/338
6,484,993 B2 * 11/2002 Huffman ..... 248/323

* cited by examiner

*Primary Examiner*—Emmanuel Marcelo
(74) *Attorney, Agent, or Firm*—Patents +TMS, P.C.

(57) ABSTRACT

A lift, a system and a method for elevating a trailer are provided. The lift may have an "A" frame for supporting the trailer. The trailer may be placed on the lift and secured to the lift. A cable attached to the lift is used to pull the lift and the trailer towards a wall. The cable, with the use of a pulley system, pulls the trailer in an upward direction towards the wall such that the lift and the trailer may be elevated in a vertical direction. The lift with the trailer may be attached to the bracket on the wall and locked into place. The lift and the trailer may be removed from the wall by releasing a lock.

26 Claims, 4 Drawing Sheets

APPARATUS AND A SYSTEM FOR LIFTING A TRAILER AND A METHOD FOR LIFTING AND STORING THE TRAILER

BACKGROUND OF THE INVENTION

The present invention generally relates to a lift and a system for elevating a trailer and a method for lifting and storing the trailer. More specifically, the lift guides and/or elevates the trailer onto, for example, a wall. In addition, the lift may have a bracket for storing the trailer on the wall.

A trailer, such as a trailer attached to, for example, a motorcycle, is generally used infrequently throughout the year. When not in use, a problem may arise in storing the trailer. Generally, the trailer is stored in a garage. However, if no garage is available or if the trailer is unable to fit in the garage, the trailer may be stored at, for example, a storage facility, a shed, an outside area, or the like. If the trailer is stored outside, the trailer may be, for example, damaged by weather, vandalized or stolen.

Of course, storing the trailer in the garage requires space within the garage and may prevent storing other items in the garage. Storing the trailer on a rack suspended from a ceiling such that the trailer is elevated above the floor is known. To use the rack, the trailer must be hoisted on the rack for storage. Hoisting the trailer is difficult and cumbersome. Usually more than one person is required to lift the trailer to the rack for storage.

The known rack is often difficult to use and does not adequately allow the trailer to be easily and quickly placed in, or removed from, the storage position. In addition, the rack does not permit the user to store the trailer in a vertical position on, for example, a wall.

A need, therefore, exists for an improved apparatus, a system and a method for a lift mountable to a wall for lifting and storing a trailer that may be accomplished by a single person. Additionally, a need exists for an improved apparatus, system and method for automatically lifting and/or storing a trailer on a wall.

SUMMARY OF THE INVENTION

The present invention generally relates to a lift and a system for elevating a trailer and a method for using the same. More specifically, the lift guides and/or elevates the trailer onto a wall. In addition, the lift may have a bracket for storing the trailer on the wall.

To this end, in an embodiment of the present invention, an apparatus for lifting a trailer from a floor to a wall wherein the floor and the wall are perpendicularly arranged with respect to each other is provided. The apparatus has a frame, a connector and an elevating means. The connector is associated with the frame and connects the frame to the trailer. The elevating means is connected to the frame wherein the elevating means advances the frame from a starting position on the floor to an end position on the wall.

In an embodiment, the apparatus has a bracket wherein the trailer is locked onto the bracket.

In an embodiment, the apparatus has a wheel attached to the frame.

In an embodiment, the apparatus has a cable and pulley associated with the elevating means.

In an embodiment, the apparatus has a first rail, a second rail and a third rail associated with the frame wherein the first rail is connected to the second rail and the third rail connects the first rail to the second rail.

In an embodiment, the apparatus has a plate connecting the first rail and the second rail.

In an embodiment, the apparatus has a pin connecting the first rail and the second rail.

In an embodiment, the connector is a ball and hitch.

In an embodiment, the connector is a pin.

In an embodiment, the apparatus has a wheel guide associated with the frame to guide the frame between the starting position to the end position.

In another embodiment of the present invention, a method for lifting a trailer from a floor to a wall wherein the floor and the wall are perpendicularly arranged with respect to each other is provided. The method has the steps of: providing a frame; placing the trailer on the frame; and lifting the frame to a position against the wall for storage.

In an embodiment, the method further has the step of adjusting the frame for placing the trailer on the frame.

In an embodiment, the method further has the step of manually pulling the frame with a cable and pulley.

In an embodiment, the method further has the step of using a motor with a cable and pulley to lift the frame.

In an embodiment, the method further has the step of locking the frame in the position against the wall.

In an embodiment, the method further has the step of placing a wheel guide under the frame to guide the frame.

In another embodiment of the present invention, a system for lifting a trailer from a floor to a wall wherein the floor and the wall are perpendicularly arranged with respect to each other is provided. The system has a frame, a wall, and an elevating means. The elevating means is attached to the frame for lifting the frame from a first position to a second position onto the wall.

In an embodiment, the system has a connection means for connecting the trailer to the frame.

In an embodiment, the system has a bracket attached to the wall for supporting the frame in the second position.

In an embodiment, the system has a guide mechanism for guiding the frame as the elevating means lifts the frame.

It is, therefore, an advantage of the present invention to provide a lift for elevating a trailer and a method and a system for lifting and storing the trailer wherein the apparatus is mountable to a wall.

Another advantage of the present invention is to provide a lift for elevating a trailer and a method and a system for lifting and storing the trailer wherein the apparatus stores a trailer.

A further advantage of the present invention is to provide a lift for elevating a trailer and a method and a system for lifting and storing the trailer wherein the apparatus has a motor which automatically elevates the trailer.

A still further advantage of the present invention is to provide a lift for elevating a trailer and a method and a system for lifting and storing the trailer wherein the apparatus is mounted in a garage.

Yet another advantage of the present invention is to provide a lift for elevating a trailer and a method and a system for lifting and storing the trailer wherein the apparatus secures the trailer in a position for storage.

Another advantage of the present invention is to provide a lift for elevating a trailer and a method and a system for lifting and storing the trailer wherein the apparatus has a wheel guide.

Yet another advantage of the present invention is to provide a lift for elevating a trailer and a method and a system for lifting and storing the trailer wherein the apparatus may be adjusted to fit various sizes of trailers.

Another advantage of the present invention is to provide a lift for elevating a trailer and a method and a system for lifting and storing the trailer wherein the apparatus may be easily installed on a wall.

A still further advantage of the present invention is to provide a lift for elevating a trailer and a method and a system for lifting and storing the trailer wherein the apparatus may be placed within the trailer and transported for use at an alternate location.

Yet another advantage of the present invention is to provide a lift for elevating a trailer and a method and a system for lifting and storing the trailer wherein the apparatus has a hand crank for manually elevating the trailer.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a lift and a system for elevating a trailer and a method for lifting and storing the trailer. More specifically, the lift guides and/or elevates the trailer onto a bracket on a wall. The trailer may be attached to the bracket for storing the trailer on the wall.

Figure 1:
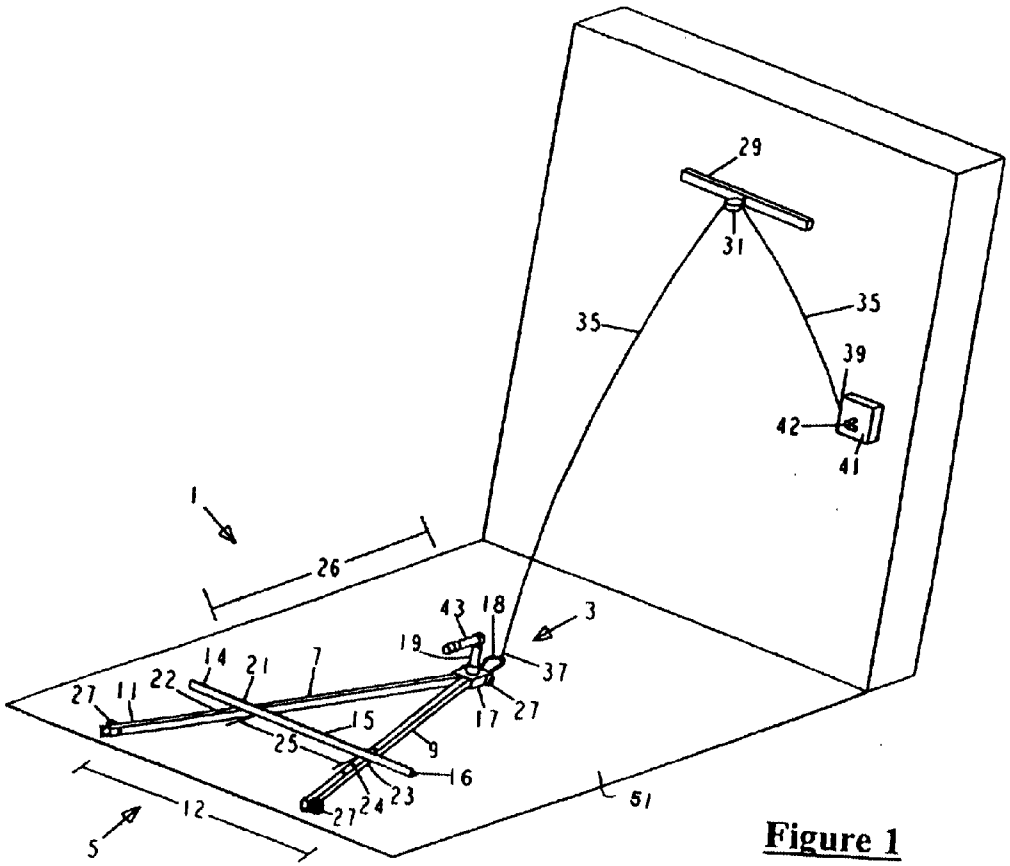
FIG. 1 illustrates a perspective view of a lift for elevating a trailer in an embodiment of the present invention.
Figure 2:
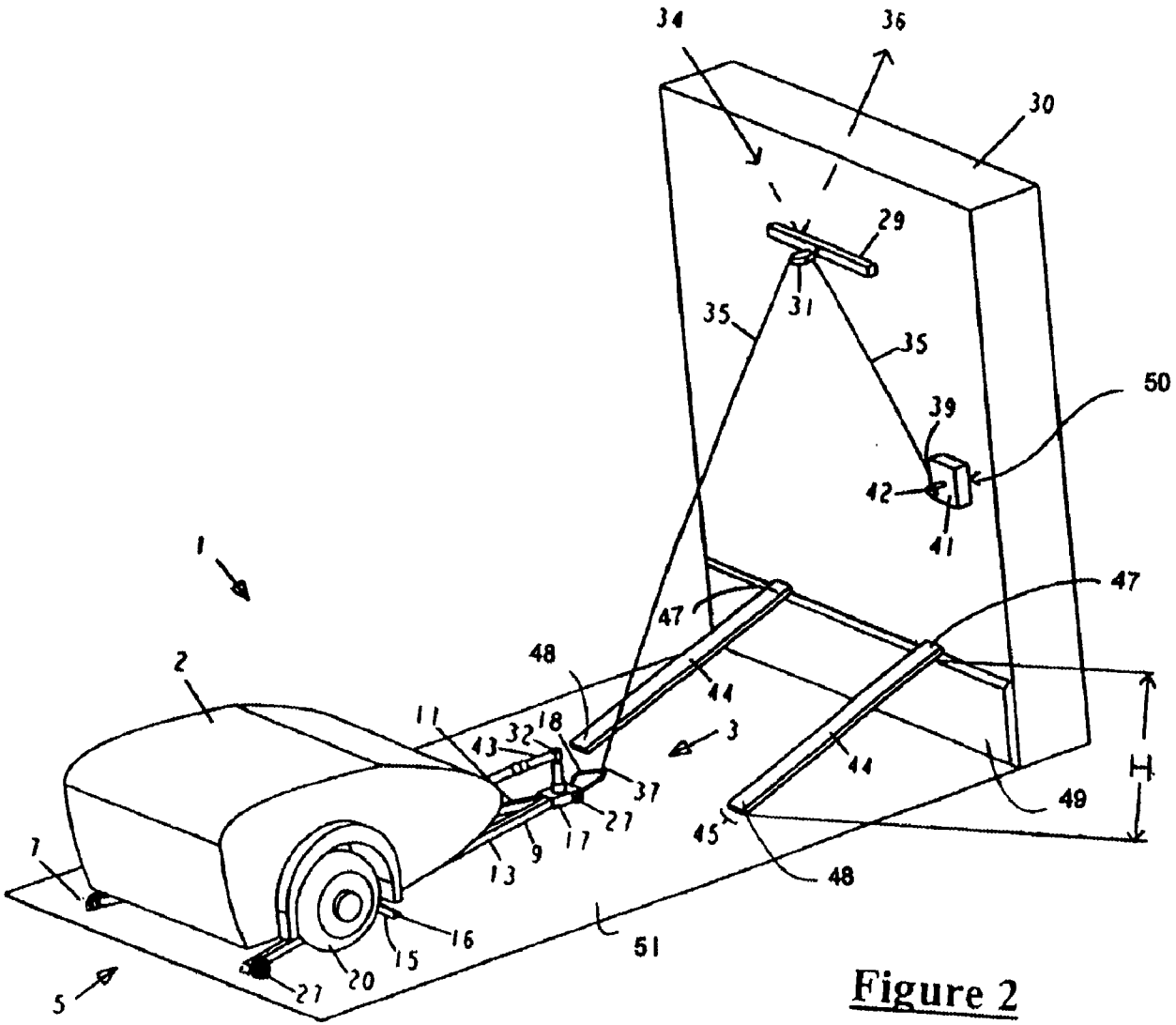
FIG. 2 illustrates a perspective view of a trailer attached to the lift in an embodiment of the present invention.

Referring now to the drawings wherein like numerals refer to like parts, FIG. 1 generally illustrates a lift 1 for a trailer 2 (as shown in FIG. 2) having a first end 3, a second end 5, a top side 7 and a bottom side 9. The lift 1 may be constructed from, for example, metal, wood, fiberglass or the like. Preferably, the lift 1 is shaped like an "A"; however, the lift 1 may be, for example, rectangular or any other shape adequate to sustain the trailer 2.

Figure 3:
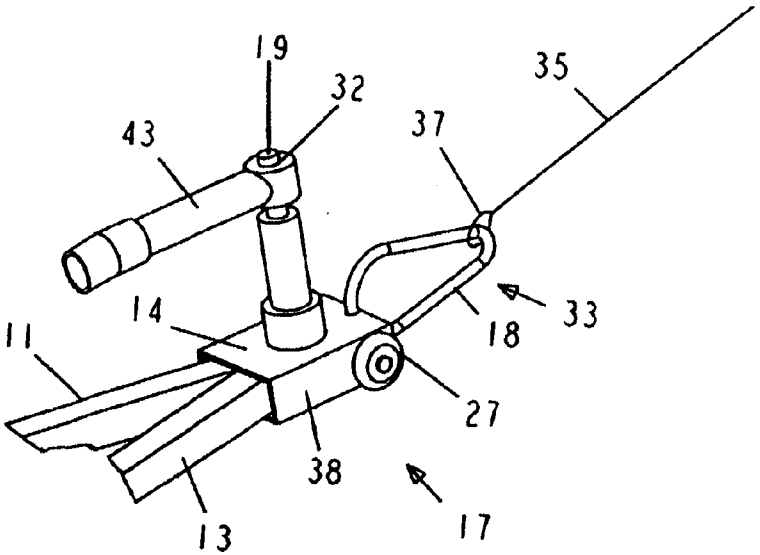
FIG. 3 illustrates a perspective view of a portion of the lift in an embodiment of the present invention.

The lift 1 may have a first rail 11, a second rail 13, and a support rail 15. The first rail 11 may be attached to the second rail 13 at the first end 3 of the lift 1. Referring to FIG. 3, a section of the first end 3 of the lift 1 is illustrated. A connector 17 may be attached at a connection 14 between the first rail 11 and the second rail 13. A pin 19 may be inserted through the first rail 11, the second rail 13 and the connector 17. The pin 19 may enable the first rail 11 and the second rail 13 to pivot with respect to each other. Of course, the first rail 11 and the second rail 13 may be attached by any means known in the art. For example, the first rail 11 and the second rail 13 may be attached by bolting the first rail 11 and the second rail 13 to a plate 38 or the like.

Referring again to FIG. 1, the support rail 15 may provide stability to the lift 1 by connecting the first rail 11 to the second rail 13, forming an "A" frame. After the support rail 15 is connected to the first rail 11 and the second rail 13, the first rail 11 and the second rail 13 may be locked into place and may not pivot with respect to each other.

The support rail 15 may be removably attached to a point 21 on the first rail 11 and to a point 23 on the second rail 13. The support rail 15 may be removed and/or may be re-attached to the first rail 11 and to the second rail 13. Removal and re-attachment of the support rail 15 may allow the user to adjust a distance 25 between the point 21 of the first rail 11 and the point 23 of the second rail 13. The user may adjust the distance 25 to enable the user to accommodate various sizes of trailers.

Figure 4:
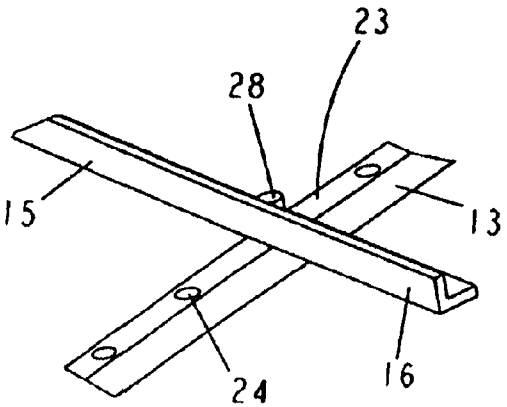
FIG. 4 illustrates a perspective view of a portion of the lift in an embodiment of the present invention.

Referring to FIG. 4, a section of the support rail 15 attached to the second rail 13 is illustrated. The support rail 15 may be detached and/or may be removed from the first rail 11 and the second rail 13 and re-attached to a second point 22 on the first rail 11 and a second point 24 on the second rail 13, respectively. The support rail 15 may be removable from the first rail 11 and the second rail 13 such that the user may adjust a distance 26 between the support rail 15 and the first end 3 of the lift 1. Further, the support rail 15 may be removable from the first rail 11 and the second rail 13 so that the user may also adjust a distance 25 between the point 21 of the first rail 11 and the point 23 of the second rail 13. The lift 1 may be adjusted to accommodate trailers of various lengths and/or sizes. Of course, other devices, such as bicycles, snowmobiles, jet skis and the like, may be placed on the lift 1 for storage as described hereinafter. The lift 1 may be adjusted by altering the distance 25 between the point 21 of the first rail 11 and the point 23 of the second rail 13. Further, the lift 1 may be adjusted by altering the distance 26 between the support rail 15 and the first end 3 of the lift.

Further, removal of the support rail 15 may allow the first rail 11 and the second rail 13 to rotate into a substantially parallel position. Rotating the first rail 11 and the second rail 13 to a substantially parallel position may allow for easier handling when transporting the lift 1 to another location or when storing the lift 1 when not in use.

The support rail 15 may be attached and/or may be removed from the first rail 11 and the second rail 13 by, for example, a bolt and a nut 28. Of course, a number of different fasteners are known and may be used with the present invention for attaching and/or for removing the first rail 11 from the second rail 13, such as, for example, magnets or the like, Further, the support rail 15 may have a length 12 defined by a top end 14 and a bottom end 16. The top end 14 of the support rail 15 may extend beyond the first rail 11. The bottom end 16 of the support rail 15 may extend beyond the second rail 13. The support rail 15 may act as an indicator of where to position the trailer 2 over the lift 1 prior to elevation and/or storage. More specifically, the support rail 15 may impede tires 20 (as shown in FIG. 2) of the trailer 2 from rolling forward and advancing to the first end 3 of the lift 1.

The first rail 11 and/or the second rail 13 may each have, for example, a wheel 27. Preferably, the first rail 11 and the second rail 13 may each have the wheel 27 attached at the second end 5 of the lift 1. The wheel 27 may be attached to the lift 1 by, for example, an axle (not shown). The wheel 27 may contact the ground when the lift 1 is placed on the ground with the top side 7 of the lift 1 facing upward. Further, the connector 17 may also have the wheel attached at the first end 3 of the lift 1. The wheels 27 may enable the lift 1 to move with minimized resistance.

The lift 1 may have a support bracket 29 mounted on, for example, a wall 30. The support bracket 29 may be secured to the wall 30 and may support at least the weight of the lift 1 and the trailer 2. Attached to the support bracket 29 may be, for example, a pulley 31.

The lift 1 may have a cable 35 having a first end 37 and a second end 39. The first end 37 of the cable 35 may be secured to, for example, a loop 18 of the connector 17. More specifically, the first end 37 of the cable 35 may be secured to the loop 18 by, for example, a hook-release mechanism 33. Of course, any device generally known in the art may be used for securing the cable 35 to the loop 18. The second end 39 of the cable 35 may be threaded through the pulley 31 and may be connected to, for example, a crank 41 having a handle 42. The crank 41 is generally known in the art and as such will not be described in detail herein.

The crank 41 may pull the cable 35 to elevate the lift 1 and/or the trailer 2. Further, the crank 41 may be mechanically operated or may be manually operated with use of the crank handle 42. To manually operate the crank 41, the crank handle 42 may be turned. Turning the crank handle 42 pulls the cable 35 into the crank 41. The cable 35 winds around a cylinder (not shown) in the crank 41. As the cable 35 winds around the cylinder in the crank 41, the cable 35 pulls the lift 1 toward the wall 30. As the cable 35 continues to pull the lift 1, the lift 1 may become elevated and may be raised against the wall 30.

Referring now to FIG. 2, the trailer 2 may be attached to the lift 1. More specifically, the lift 1 may be placed on the ground, and the tires 20 of the trailer 2 may roll over the top side 7 of the lift 1, positioning the trailer 2 over the lift 1. The tires 20 of the trailer 2 may contact with support rail 15.

Figure 5:
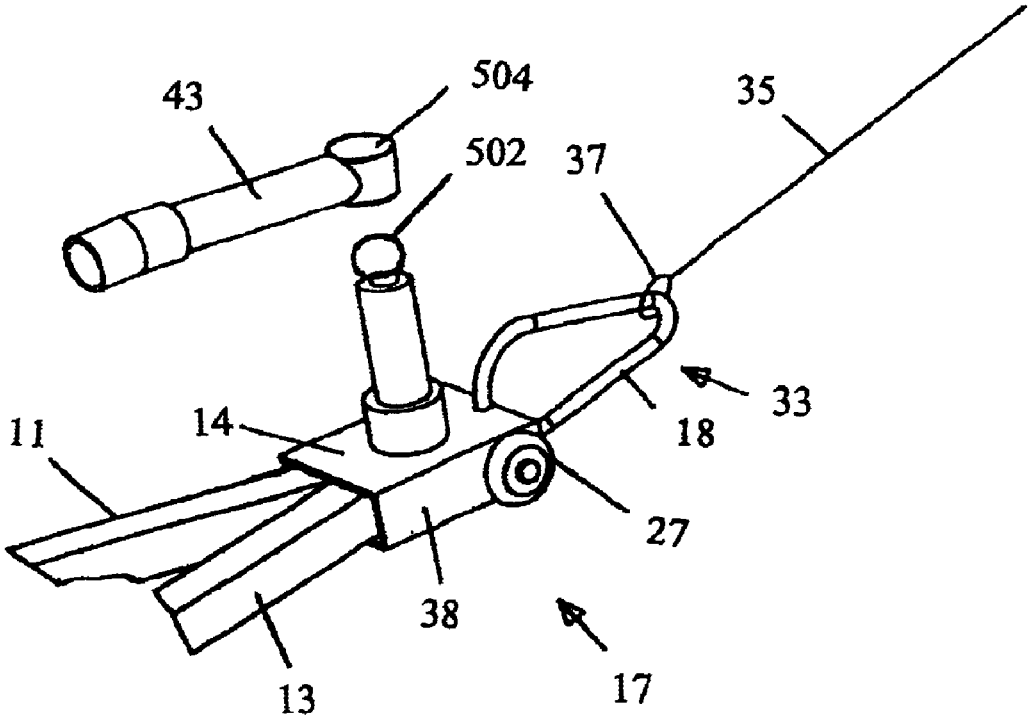
FIG. 5 illustrates a perspective view of a portion of the lift in an embodiment of the present invention.

A connecting bar 43 associated with the trailer 2 may be attached to the lift 1 by a pin 19 of the connector 17. Moreover, the connecting bar 43 may be attached to the pin 19 by, for example, placing the pin 19 within a hole 32 on the connecting bar 43 and locking the connecting bar 43 onto the pin 19. The connecting bar 43 may be locked onto the pin 19 by, for example, a bolt and a nut or the like. As further illustrated in FIG. 5, any connecting device known in the art may be used to attach the trailer 2 to the lift 1, such as, for example, a ball 502 and a hitch 504 connection or the like.

Guide rails 44 may guide the wheels 27 of the lift 1 as the lift 1 is pulled. Each of the guide rails 44 may have a first end 47 and a second end 48. The first end 47 of each of the guide rails 44 may be placed on a ledge 49 against the wall 30. The ledge 49 may support the first end 47 of each of the guide rails 44. The ledge 49 may be attached to the wall 30 as shown in FIG. 2 or may be a block or other object placed against the wall 30 for supporting and/or elevating the first end 47 of each of the guide rails 44 a distance "H" higher than the second end 48 of each of the guide rails 44. The second end 48 of each of the guide rails 44 may be placed on a ground 51 and may be aligned with the wheels 27 at the second end 5 of the lift 1. The second end 48 of each of the guide rails 44 may be placed on the ground 51 in front of the tires 20 of the trailer 2. Further, the guide rails 44 may align the trailer 2 with the lift 1 prior to rolling the trailer 2 over the top side 7 of the lift 1. Further, the guide rails 44 may have a width 45 which may, for example, accommodate various sized tires.

After the connecting bar 43 of the trailer 2 is secured onto the pin 19, the trailer 2 may be elevated and may be stored on the wall 30. Moreover, the crank handle 42 of the crank 41 may be manually turned to pull on the second end 39 of the cable 35. Alternatively, a motor 50 associated with the crank 41 may power the crank 41 to pull on the second end 39 of the cable 35. A force 34 may be exerted on the second end 39 of the cable 35 and may be directed through the pulley 31 to the loop 18 of the lift 1. The force 34 directed through the pulley 31 may create a force 36 on the cable 35. The force 36 may pull the cable 35 and the loop 18 such that the lift 1 is pulled onto or against the wall 30. Use of the guide rails 44 may assist in guiding the lift 1 toward and/or onto the wall 30 until the lift 1 and the trailer 2 are in a vertical position against the wall 30.

After the lift 1 and the trailer 2 have reached a vertical position against the wall 30, the crank 41 may lock, and the lift 1 with the trailer 2 may remain in position for storage. The crank 41 may release the trailer 2 from the elevated storage position, and the lift 1 and the trailer 2 may descend toward the ground. Preferably, the cable 35 is released gradually from the crank 41 so that the lift 1 and the trailer 2 do not descend toward the ground.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An apparatus for lifting a trailer from a floor to a wall wherein the floor and the wall are perpendicular to each other, the apparatus comprising:

a frame;

a connector associated with the frame wherein the connector connects the frame to the trailer; and an elevating means connected to the frame wherein the elevating means advances the frame from a starting position on the floor to an end position on the wall wherein the frame is perpendicular to the floor in the end position.

2. The apparatus of claim 1 further comprising:

a bracket on the wall wherein the trailer is supported by the bracket.

3. The apparatus of claim 1 further comprising:

a wheel attached to the frame.

4. The apparatus of claim 1 further comprising:

a cable and pulley associated with the elevating means.

5. The apparatus of claim 4 further comprising:

a plate connecting the first rail and the second rail.

6. The apparatus of claim 4 further comprising:

a pin connecting the first rail and the second rail.

7. The apparatus of claim 1 further comprising:

a first rail, a second rail and a third rail associated with the frame wherein the first rail is connected to the second rail and the third rail connects the first rail to the second rail.

8. The apparatus of claim 1 wherein the connector is a ball and hitch.

9. The apparatus of claim 1 wherein the connector is a pin.

10. The apparatus of claim 1 further comprising:

a wheel guide associated with the frame to guide the frame between the starting position to the end position.

11. A method for lifting a trailer from a floor to a wall wherein the floor and the wall are perpendicularly arranged with respect to each, the method comprising the steps of:

providing a frame connected to an elevation means;

placing the trailer on the frame;

lifting the frame with the elevation means from a first position parallel with respect to the floor to a second position perpendicular with respect to the wall; and placing a wheel guide under the frame to guide the frame.

12. The method of claim 11 further comprising the step of:

adjusting the frame for placing the trailer on the frame.

13. The method of claim 11 further comprising the step of:

manually pulling the frame with a cable and pulley.

14. The method of claim 11 further comprising the step of:

using a motor with a cable and pulley to lift the frame.

15. The method of claim 11 further comprising the step of:

locking the frame in the second position against the wall.

16. A system for lifting a trailer from a floor to a wall wherein the floor and the wall are perpendicularly arranged with respect to each other, the system comprising:

a frame having a first end and a second end opposite to the first end;

a wall; and an elevating means attached to the first end of the frame for lifting the frame from a first position to a second position onto the wall.

17. The system of claim 16 further comprising:

a connection means for connecting the trailer to the frame.

18. The system of claim 16 further comprising:

a bracket attached to the wall for supporting the frame in the second position.

19. The system of claim 16 further comprising:

a guide mechanism for guiding the frame as the elevating means lifts the frame.

20. An apparatus for lifting a trailer from a floor to a wall wherein the floor and the wall are perpendicularly arranged with respect to each other, the apparatus comprising:

a frame;

a connector associated with the frame wherein the connector connects the frame to the trailer;

an elevating means connected to the frame wherein the elevating means advances the frame from a starting position on the floor to an end position on the wall; and a wheel attached to the frame.

21. An apparatus for lifting a trailer from a floor to a wall wherein the floor and the wall are perpendicularly arranged with respect to each other, the apparatus comprising:

a frame;

a connector associated with the frame wherein the connector connects the frame to the trailer;

an elevating means connected to the frame wherein the elevating means advances the frame from a starting position on the floor to an end position on the wall;

a cable and pulley associated with the elevating means; and a plate connecting the first rail and the second rail.

22. An apparatus for lifting a trailer from a floor to a wall wherein the floor and the wall are perpendicularly arranged with respect to each other, the apparatus comprising:

a frame;

a connector associated with the frame wherein the connector connects the frame to the trailer;

an elevating means connected to the frame wherein the elevating means advances the frame from a starting position on the floor to an end position on the wall;

a cable and pulley associated with the elevating means; and a pin connecting the first rail and the second rail.

23. An apparatus for lifting a trailer from a floor to a wall wherein the floor and the wall are perpendicularly arranged with respect to each other, the apparatus comprising:

a frame;

a connector associated with the frame wherein the connector connects the frame to the trailer; and an elevating means connected to the frame wherein the elevating means advances the frame from a starting position on the floor to an end position on the wall wherein the connector is a ball and hitch.

24. An apparatus for lifting a trailer from a floor to a wall wherein the floor and the wall are perpendicularly arranged with respect to each other, the apparatus comprising:

a frame;

a connector associated with the frame wherein the connector connects the frame to the trailer; and an elevating means connected to the frame wherein the elevating means advances the frame from a starting position on the floor to an end position on the wall wherein the connector is a pin.

25. An apparatus for lifting a trailer from a floor to a wall wherein the floor and the wall are perpendicularly arranged with respect to each other, the apparatus comprising:

a frame;

a connector associated with the frame wherein the connector connects the frame to the trailer;

an elevating means connected to the frame wherein the elevating means advances the frame from a starting position on the floor to an end position on the wall; and a wheel guide associated with the frame to guide the frame between the starting position to the end position.

26. A method for lifting a trailer from a floor to a wall wherein the floor and the wall are perpendicularly arranged with respect to each, the method comprising the steps of:

providing a frame connected to an elevation means;

placing the trailer on the frame;

lifting the frame with the elevation means to a position against the wall; and placing a wheel guide under the frame to guide the frame.

* * * * *